US005313139A

United States Patent [19]

Yoon

[11] Patent Number: 5,313,139

[45] Date of Patent: May 17, 1994

[54] CONDENSER UNIT FOR A MAGNETRON CAPABLE OF PREVENTING THE LEAKAGE OF MICROWAVE ENERGY

[75] Inventor: Yong G. Yoon, Kyungsangbook, Rep. of Korea

[73] Assignee: Goldstar Co., Ltd., Seoul, Rep. of Korea

[21] Appl. No.: 721,979

[22] Filed: Jun. 27, 1991

[30] Foreign Application Priority Data

Jun. 30, 1990 [KR] Rep. of Korea ..... 9796/1990

[51] Int. Cl.[5] ..... H01J 23/15; H01J 25/50

[52] U.S. Cl. ..... 315/39.51; 315/39.53

[58] Field of Search ..... 315/39.51, 39.53

[56] References Cited

U.S. PATENT DOCUMENTS 4,131,824 12/1978 Nakai et al. ..... 315/39.53 X
4,720,658 1/1988 Tsuzurahara ..... 315/39.53 X
4,752,720 6/1988 Oguro et al. ..... 315/39.53 X

FOREIGN PATENT DOCUMENTS 47934 3/1987 Japan ..... 315/39.51
113337 5/1987 Japan ..... 315/39.51
218122 9/1988 Japan ..... 315/39.51

*Primary Examiner*—Robert J. Pascal
*Assistant Examiner*—Benny T. Lee
*Attorney, Agent, or Firm*—Rosen, Dainow & Jacobs

[57] ABSTRACT

A condenser unit for magnetron comprising a condenser and a mounting plate. The mounting plate is adapted to fixedly mount the condenser to the upper filter box and provided with an elastic periphery member formed as outwardly extending from the periphery of the mounting plate in order to be inclined upwardly at an angle on the basis of plane of the mounting plate. The elastic periphery member comprises a plurality of slender pieces and slits in order to completely elastically cover a gap which is formed between the mounting plate of the condenser unit and the upper filter box. The elastic periphery member and each slit are formed as having a predetermined height and a predetermined width which are fixed as being relatively smaller than or the same with one fourth of crest value and one fourth of wave length of the fifth higher harmonic, respectively. The inclined angle of the periphery member is ranged from about 30°-about 70°.

2 Claims, 3 Drawing Sheets

CONDENSER UNIT FOR A MAGNETRON CAPABLE OF PREVENTING THE LEAKAGE OF MICROWAVE ENERGY

BACKGROUND OF THE INVENTION

The present invention relates to a magnetron for an electronic range for generating a microwave, and more particularly to a condenser unit for the magnetron, wherein the unit has a condenser mounting plate capable of preventing the leakage of microwave through the connecting portion of the condenser mounting plate and a filter box of the magnetron.

A magnetron for an electronic range is a kind of an electron tube which has been adapted for generating microwave energy, at generally high frequency, for defrosting and heating articles of food by means of dielectric heating thereof. A known magnetron has a conventional structure as shown in FIGS. 1 and 2, which are a partially sectioned elevational view of the known magnetron and a partially side-sectioned view showing the connection of the penetration-type condenser with the filter boxes of the magnetron of FIG. 1, respectively.

As shown in FIGS. 1 and 2 of the drawings, a conventional magnetron generally comprises a housing 11 having a filament 1 for emitting thermions, the thermions being "thermal electrons" which are emitted from a solid body by being excited with a thermal energy when metal or semiconductor is heated at a very high temperature. The magnetron generally also comprises an anode vane 2 to which the thermions from the filament 1 are directed, a permanent magnet 3 for rotating and accelerating the thermions, a radiating antenna 4 for radiating high-frequency electromagnetic wave energy, a plurality of radiant tubes 5 each adapted to radiate heat generated from the anode vane 2 in order to cool the anode vane 2, a lead 6 for leading electric power to the filament 1, a choke coil 7 for dumping conductive noise emitted from the lead 6, a penetration-type condenser 8 adapted for improving the dumping efficiency of the conductive noise in cooperation with the choke coil 7 and functioning as a terminal for facilitating the application of electric power from the power source, and upper and lower filter boxes 9 and 10 each adapted to shield radiation noise emitted from the lead 6.

The microwave energy generated by the above-mentioned magnetron has a frequency of about 2450 Mhz and is radiated at the radiating antenna 4 of the magnetron toward the cooking chamber of the electronic range.

On the other hand, the high-frequency electromagnetic wave will also be applied to the input part comprising the filament 1 and the lead 6, simultaneously with being applied to the radiating antenna 4.

The high-frequency electromagnetic wave applied to the lead 6 has been generally denoted as the conductive noise, while the electromagnetic wave radiated from the lead which functions as if it was an antenna radiating into the space of the input part, has been generally denoted as the radiation noise.

Each of the above-mentioned two-types of noise is emitted from the magnetron so as to cause interference in television or communication machinery.

Most of the conductive noise emitted from the input part of the magnetron toward the outside could be prevented by the choke coil 7 and the penetration-type condenser 8, and also the radiation noise emitted from the lead 6 into the inner space of the input part could most likely be prevented by sealing tightly both upper and lower filter boxes 9 and 10, the filter boxes 9 and 10 covering the inner space of the input part.

The upper filter box 9 is necessarily provided with a condenser receiving opening **9*b* at the center of a front panel thereof and a plurality of mounting holes 9*a*, the mounting holes 9*a* being arranged around the receiving opening 9*b*, because the upper and lower filter boxes 9 and 10 must be assembled with other parts such as the condenser 8 so that the upper and lower filter boxes 9 and 10 are necessarily formed to be separate from one another as shown in FIG. 3. In assembling the upper filter box 9 to the condenser 8, each mounting hole 81*a* formed in the mounting plate 81 of the condenser 8, in order to correspond to each mounting hole 9*a* of the upper filter box 9, is first inserted onto each burring protrusion $9a_1$ formed to integrally extend from each mounting hole 9*a* of the upper filter box 9 as shown in FIG. 4, and thereafter, each burring protrusion $9a_1$ is pressed by means of a pair of pressing jigs $j_1$, $j_2$ in order to tightly mount the condenser 8 to the upper filter box 9 as shown in FIG. 5 so that there is inherently a gap G between the front surface of said mounting plate 81 of the condenser 8 and the bent rear surface of a burring plate portion 91 of the upper filter box 9, the gap G inherently formed as the burring plate portion 91 of the upper filter box 9 is gently bent upon the depression of each burring protrusion 9 during the burring process by means of the pressing jigs $j_1$, $j_2$. In an effort to remove the bending gap G, an assembly method has been proposed in which the burring plate portion 91 of the upper filter box 9 is previously bent in the opposite direction before the burring process, and then the burring protrusions $9a_1$ are each pressed by the pressing jigs, thereby making it possible to remove the gap G by offsetting the press bending effected by the previous opposite bending. However, it is known that the assembling method has disadvantages of difficulty in calculating the bending dimensional tolerance. The dimensional tolerance may be obtained from repeated experiments, and furthermore, there is a limit in providing the perfect sealing condition for the upper and lower filter boxes 9 and 10**.

In addition, it is known that there is another disadvantage because of the bending gap G, such as leakage of large quantity of frequencies of the fifth higher harmonic therethrough, the fifth higher harmonic having a considerably shorter wave length than that of the basic frequency and causing problems such as in the reception of satellite communication to occur.

SUMMARY OF THE INVENTION

It is, therefore, an object of the present invention to provide a condenser unit for a magnetron including a mounting plate which can completely cover a gap formed between the mounting plate and a burring plate portion of an upper filter box of the magnetron so that the upper and lower filter boxes can be sealed tightly, thereby making it possible to efficiently inhibit the leakage of radiation from a lead of the magnetron.

It is another object of the present invention to provide a condenser unit for a magnetron including a mounting plate capable of efficiently inhibiting the leakage of the fifth higher harmonic which may occur through the connecting portion of the mounting plate of the condenser unit and the burring plate portion of filter boxes.

In one aspect, the present invention can provide, in a magnetron comprising a filament for emitting thermions, an anode vane to which the thermions from said filament are directed, a permanent magnet for rotating and accelerating said thermions, a radiating antenna for radiating highfrequency electromagnetic wave energy, a plurality of radiant tubes each adapted to radiate heat generated from the anode vane in order to cool the anode vane, a lead for leading electric power to the filament, a choke coil, upper and lower filter boxes, and a condenser unit mounted to penetrate the upper filter box. The condenser unit comprises a condenser functioning as a terminal for applying electric power from a power source to the lead; a mounting plate adapted to fixedly mount the condenser to the upper filter box and provided with an elastic periphery member that extends outward in an inclined manner from the periphery of said mounting plate. The elastic periphery member comprises a plurality of slender pieces separated by slits in order to completely elastically cover a gap which is formed between the mounting plate of the condenser unit and the upper filter box during press mounting of the condenser unit to the upper filter box by means of pressing jigs.

In another aspect, the present invention can provide a condenser unit for a magnetron comprising a condenser and a mounting plate, which mounting plate is provided with an elastic periphery member which is inclined upwardly at an angle $\theta$ with respect to the plane of the mounting plate and having a height $H_1$ and comprises a plurality of slender pieces separated by slits. Each of the slits has a width $W_1$. The inclined angle $\theta$ ranges from about 30°–about 70° and the height $H_1$ and width $W_1$ are lower and shorter, respectively, than, or the same as, one fourth of the crest height i.e., peak amplitude of the waves and one fourth of the wave length of the fifth higher harmonic having the frequency of 12.25 GHz, or five times larger than that of the basic frequency, respectively.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 6:
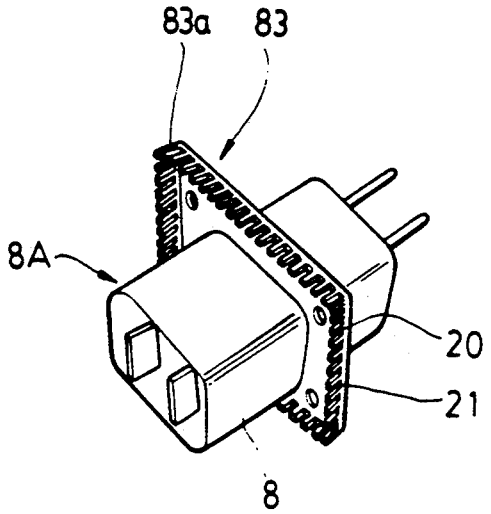
FIG. 6 is a perspective view of a condenser unit including a mounting plate in accordance with the present invention.
Figure 7:
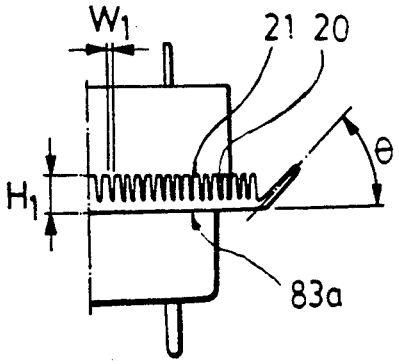
FIG. 7 is a schematic view showing the shape of each slit of the mounting plate of FIG. 6.

Referring now to FIGS. 6 and 7 which are a perspective view of a condenser unit including a mounting plate in accordance with the present invention and a schematic view showing the shape of each slit of the mounting plate of FIG. 6, respectively, the condenser unit 8A has a mounting plate 83 provided with an inclined periphery member **83*a* extruding outwardly from the outer edge of the mounting plate 83. The periphery member 83*a* is integrally formed with the mounting plate 83 and is inclined toward a socket of the outer terminal of said condenser unit 8A at an angle of $\theta$ (see FIG. 7) with respect to the horizontal plane of the mounting plate 83**.

The inclined periphery member **83*a* has a height of $H_1$ and is provided with a plurality of slender pieces 21 which are formed between slits 20, the slits 20 each having a width $W_1$ as shown in FIG. 7**.

In addition, the height $H_1$ of the inclined periphery **83*a* and the width $W_1$ of each slit 20 are desirably lower and shorter than, or the same as, one fourth of the crest height and one fourth of the wave length of the fifth higher harmonic, respectively, the fifth higher harmonic having the frequency of 12.25 GHz, or a five times higher frequency than the basic frequency. The range of the angle $\theta$ is desirably from about 30° to about 70°, considering the compressed contacting condition thereof with the burring plate portion 91 of upper filter box 9**.

Figure 8:
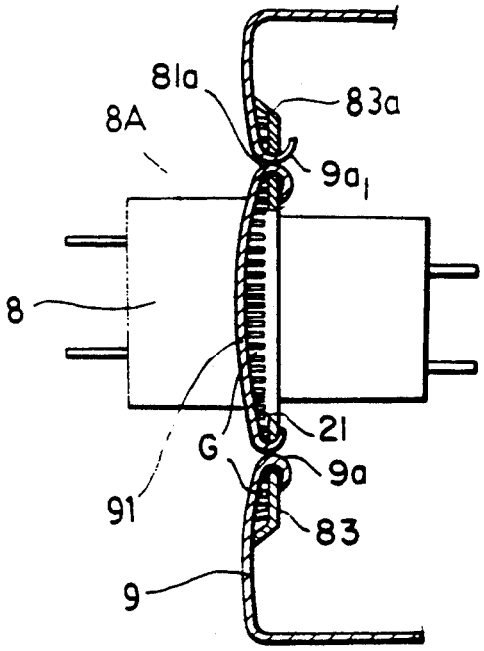
FIG. 8 is a view corresponding to FIG. 5, but showing the present invention.

The operational effect of a magnetron provided with the condenser unit 8A in accordance with this invention will be described hereinafter in conjunction with FIGS. 8 and 9 which are a sectional view showing the connecting portion of the condenser unit 8A and the filter boxes 9 and 10 after assembling and a rear view of the mounting plate 83 shown at the arrow A of FIG. 8, respectively.

Figure 1:
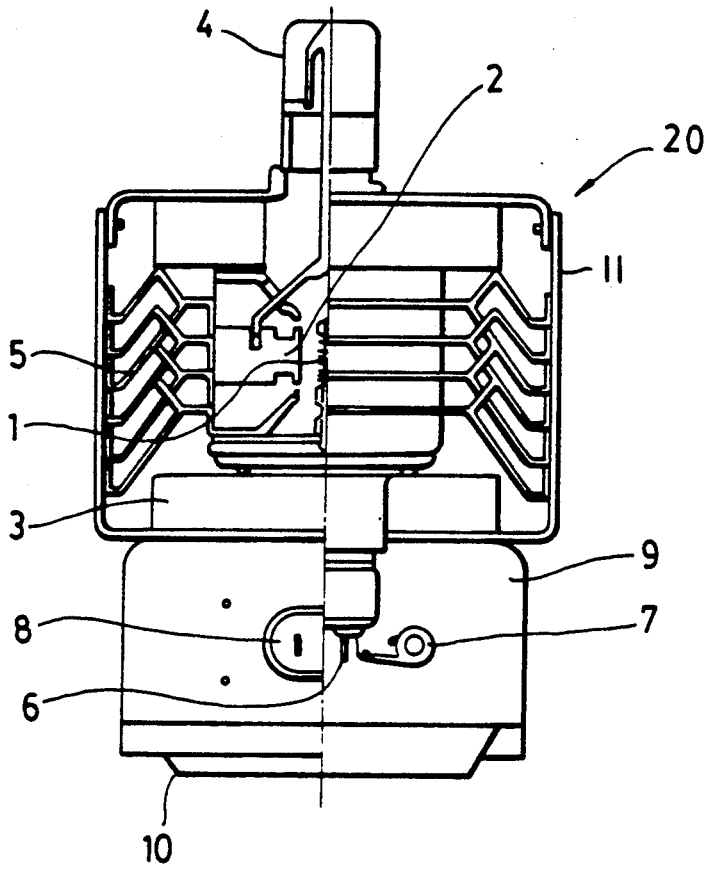
FIG.1 PRIOR ART
FIG. 1 is a partially sectioned elevational view of a known magnetron in accordance with the prior art.
Figure 2:
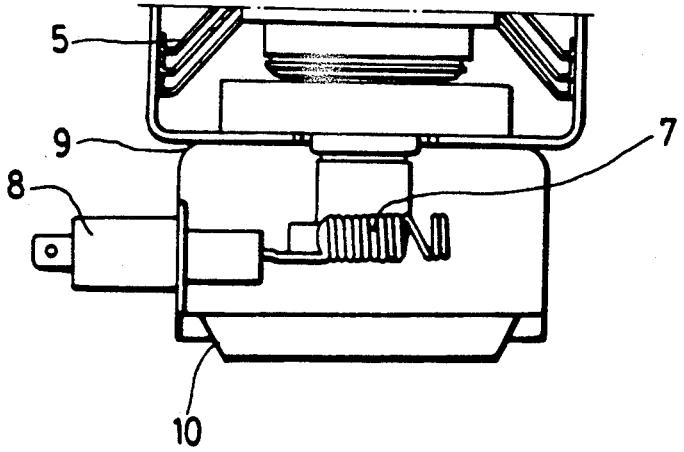
FIG.2 PRIOR ART
FIG. 2 is a partially cross-sectional side elevation view showing the connection of the penetration-type condenser with the filter boxes of the magnetron of FIG. 1.
Figure 3:
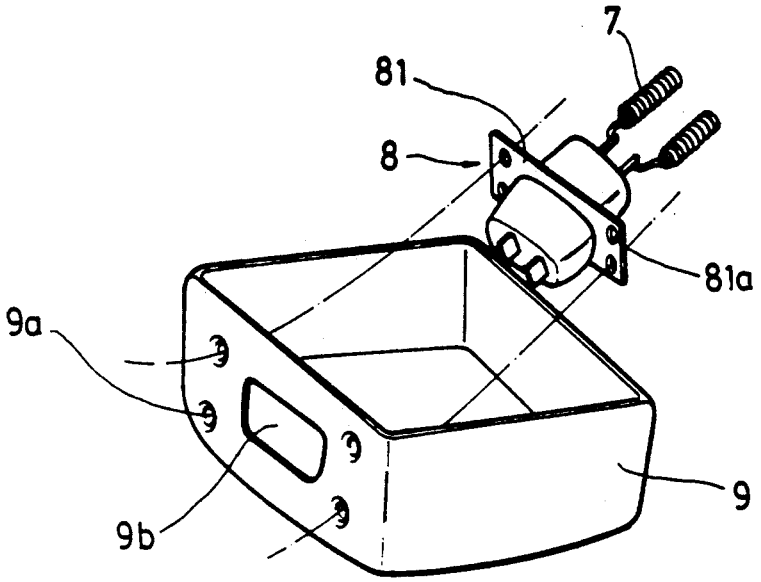
FIG.3 PRIOR ART
FIG. 3 is an exploded perspective view showing the assembling of the upper filter box with the condenser of FIG. 2.
Figure 4:
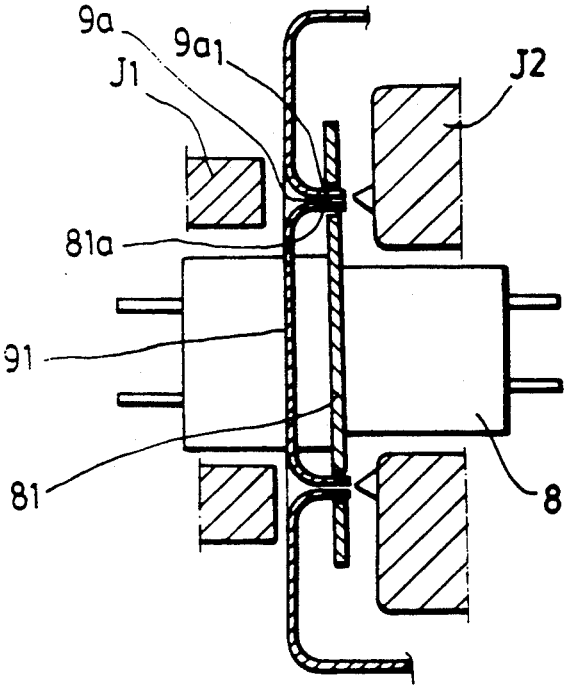
FIG.4 PRIOR ART
FIG. 4 is partially cross-sectional view showing the first state in the assembly of the upper filter box with the condenser unit of FIG. 2 in connection with the pressing jigs.

In assembling the condenser unit 8A with the upper filter box 9, each burring protrusion, $9a_1$ of the upper filter box 9 is first inserted into a respective mounting hole **81*a* of the mounting plate 83 so that the free end of each slender piece 21 of the inclined periphery member 83*a* may contact the rear surface of the burring plate portion 91 of the upper filter box 9, and thereafter, upon pressing each burring protrusion $9a_1$ with a pair of pressing jigs (see FIG. 4) so as to tightly mount the condenser unit to the upper filter box 9, each slender piece 21 elastically tightly contacts the rear surface of the burring plate portion 91 so that the gap G formed between the mounting plate 83 and the upper filter box 9 can be completely covered with slender pieces 21**.

Figure 5:
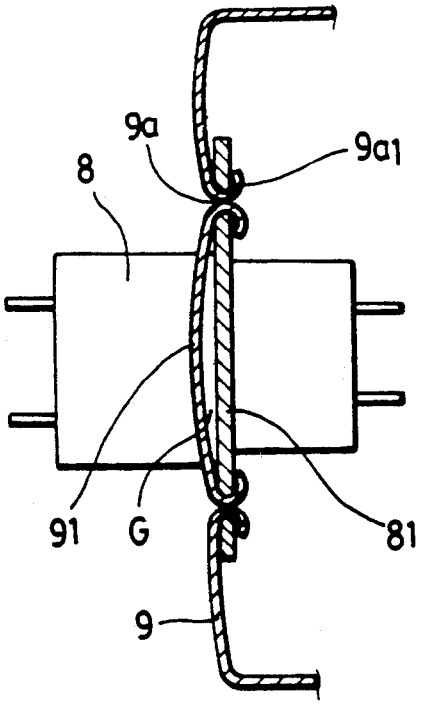
FIG.5 PRIOR ART
FIG. 5 is a cross-sectional view showing the connecting portion of the condenser unit and the filter boxes after accomplishing the assembly.
Figure 9:
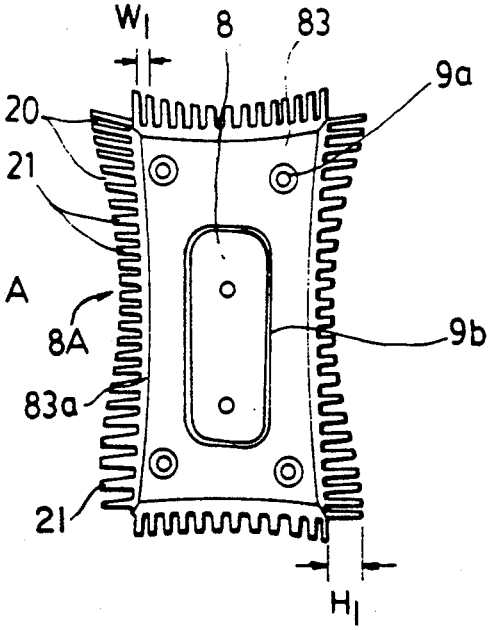
FIG. 9 is a rear view of the mounting plate shown at the arrow A of FIG. 8.

At this time, a part of the slender pieces 21 near the mounting holes **9*a* of upper filter box 9 are sufficiently spread out, while the other part of said slender pieces 21 near the center portion of the periphery member 83*a*, the center portion having the largest gap G, are nearly spread out as shown in FIG. 9, thereby making it possible to completely cover all of the gap G (best shown in FIG. 5) with slender pieces 21**, resulting in efficient inhibiting of the passage of radiation noise through the gap G.

In addition, all of the free ends of the slender pieces 21 tightly elastically contact the rear surface of the upper filter box 9, and also the height $H_1$ of the periphery member 83*a* and the width $W_1$ of each slit 20 are the same, and less than one fourth of the crest height and one fourth of the wave length at frequencies of 12 GHz band of the fifth higher harmonic, respectively, so that leakage of the fifth higher harmonic, respectively, which may occur through the connecting part of the condenser unit with the filter boxes 9 and 10, can be efficiently inhibited.

As described above, the condenser unit for a magnetron in accordance with this invention can completely prevent the leakage of high frequency energy through the connecting part of the condenser unit with the upper filter box by means of mounting plate thereof provided with the elastic slender pieces, wherein the slender pieces completely cover the gap G formed between the mounting plate and the upper filter box, thereby efficiently preventing the jamming phenomenon which may occur as a result of leakage of high frequency energy.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A magnetron assembly, operable with an electric power source, said magnetron assembly comprising: a housing, a cathode having a filament for emitting thermions, an anode vane assembly having an anode and a plurality of cavities disposed therein to which said thermions from said filament are directed, a permanent magnet mounted to said housing to rotate and accelerate said thermions between said anode and cathode such that said thermions interact with said cavities to generate electromagnetic wave energy at a high frequency, a radiating antenna mounted to and extending from said housing for radiating said high-frequency electromagnetic wave energy from said magnetron, a plurality of radiant tubes mounted to said housing to radiate heat from said anode vane assembly in order to cool said anode vane assembly, a lead connected between said filament and said power source so as to direct electric power from said power source to said filament, upper and lower filter boxes joined to one another and connected to said housing, and a condensor unit mounted to penetrate said upper filter box, said condenser unit comprises:

a condenser comprising a terminal connected to said lead to receive electrical power; and a mounting plate defining a plane and fixedly mounting said condenser to said upper filter box, said mounting plate having a periphery and an elastic periphery member mounted to said periphery to extend outwardly therefrom, said elastic periphery member extending in a direction that is inclined at an angle with respect to said plane of said mounting plate, said elastic periphery member comprising a plurality of slender pieces separated by slits and completely elastically covering a gap between said mounting plate of said condenser unit and said upper filter box, said elastic periphery member and each said slit having a predetermined height and a predetermined width.

2. The magnetron of claim 1, wherein said height of the elastic periphery member and said width of each slit are no larger than one fourth of a peak amplitude and one fourth of the wavelength of said electro-magnetic wave energy at a high frequency of 12.25 GHz, respectively, and said angle being within the range of about 30° to about 70°.

* * * * *